United States Patent [19]

Moore

[11] 4,168,619

[45] * Sep. 25, 1979

[54] PROCESS FOR FORGING METALLIC NOZZLES

[76] Inventor: Charles H. Moore, 645 Matanzas Ct., Fort Myers Beach, Fla. 33931

[ * ] Notice: The portion of the term of this patent subsequent to May 1, 1996, has been disclaimed.

[21] Appl. No.: 897,129

[22] Filed: Apr. 17, 1978

Related U.S. Application Data

[63] Continuation-in-part of Ser. No. 836,147, Sep. 23, 1977, and Ser. No. 825,381, Aug. 17, 1977, which is a continuation-in-part of Ser. No. 548,070, Feb. 7, 1975, abandoned.

[51] Int. Cl.[2] ..... B21C 35/04; B21D 28/00

[52] U.S. Cl. ..... 72/255; 72/264; 72/334; 72/352; 72/354; 72/356

[58] Field of Search ..... 72/334, 255, 352–354, 72/356, 264, 343, 253, 326, 327, 331, 333, 338, 254

[56] References Cited

U.S. PATENT DOCUMENTS

| | | | |
|---|---|---|---|
| 2,348,179 | 5/1944 | Moore | 72/343 |
| 2,392,175 | 1/1946 | Norton | 72/343 |
| 3,149,416 | 9/1964 | Moore | 72/353 |

FOREIGN PATENT DOCUMENTS

| | | | |
|---|---|---|---|
| 651946 | of 1965 | Belgium | 72/352 |
| 12137 | of 1885 | United Kingdom | 72/354 |
| 498089 | 5/1976 | U.S.S.R. | 72/353 |

*Primary Examiner*—Charlie T. Moon
*Assistant Examiner*—D. M. Gurley

[57] ABSTRACT

A single step in the form of a heavy forward displacing forging operation is used to manufacture cylindrically bored ferrous-metal multiple diameter nozzles with an outside diameter of at least 22 inches, weighing at least 4,000 lbs. and possessing an exterior configuration comprising a round cylindrical base section of largest diameter with an outwardly-extending flange at one extremity, spaced second cylindrical section of smaller diameter, and an interconnecting and intercommunicating frusto-conical section.

2 Claims, 9 Drawing Figures

FIG. 1
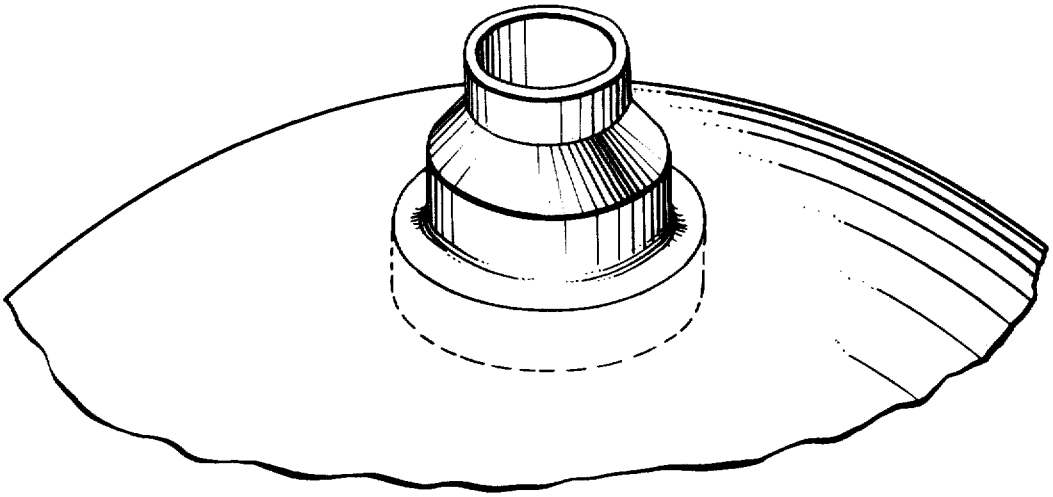
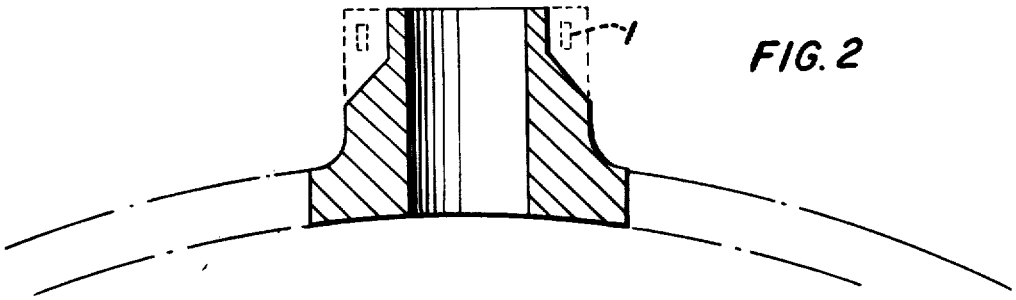
FIG. 2
FIG. 3
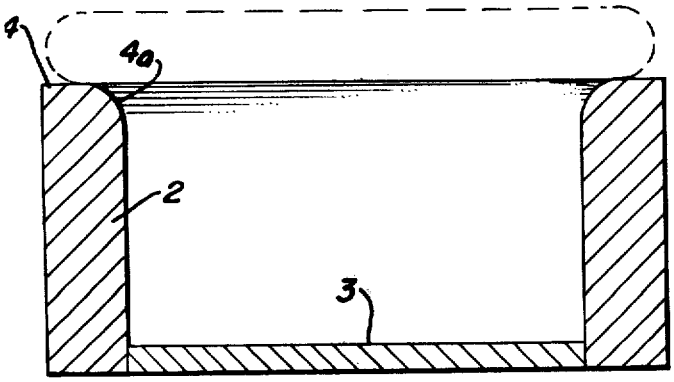
FIG. 4
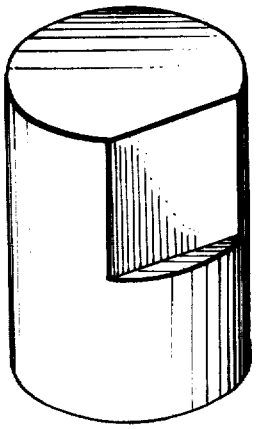

ESTABLISHED RESULT OF THE INVENTIONS

PROCESS FOR FORGING METALLIC NOZZLES

This application is a continuation-in-part of both my patent application Ser. No. 836,147, filed Sept. 23, 1977, and patent application Ser. No. 825,381, filed Aug. 17, 1977, the latter being a continuation-in-part of my patent application Ser. No. 548,070, filed Feb. 7, 1975 now abandoned.

The present invention relates to the manufacture of very large, heavy-duty, self-reinforcing, heavy ferrous-metal cylindrically bored nozzles for nuclear reactors which possess an exterior of multiple diameters. Such nuclear nozzles mandatorily require, in exterior configuration, a large round base member having an outwardly extending or generally radial flange for insert-welding in an opening in the curved wall of a metallic vessel forming part of the nuclear reactor; a second, and outer, co-axial round section of substantially lesser diameter; and an intermediate and interconnecting section of true frusto-conical configuration.

Nuclear Nozzles used on or in connection with nuclear reactors must be very large in size, as this term is understood in the particular art of hot-forging large ferrous-metal bodies; frequently weighing 20,000 to 25,000 lbs., and having a diameter at the narrowest point of 44 inches or more; and they must, because of the very heavy duty to which they are subjected in service, be very strongly reinforced. Never does a nuclear nozzle of the type to which the present invention relates weigh less than 4,000 lbs. and never does it possess a diameter at its narrowest point of less than 22 inches. Perhaps only a dozen or so forge shops in the United States possess equipment which is capable of manufacturing such products, and of these only a half-dozen or so have employees who possess the knowledge and skill to employ such equipment to successfully produce such nuclear nozzles.

The extemely vexacious problems which attend their manufacture, and the removal therefrom of adequate test specimens are completely unknown and even unheard of by workers of average skill in the every-day world of hot-forging ferrous-metal bodies, even hot-working ferrous-metal bodies which are considered by most workers in the forging industry to be of very large size.

The criteria for producing nuclear nozzles are established by the "Nuclear Codes", as promulgated by The American Society Of Mechanical Engineers, 345 East 47th Street, New York City, N.Y. 10017; and they differ to a very real extent from the practices of commonplace forging operations and products obtained thereby.

Large nuclear nozzles of the mandatory exterior configuration described hereinbefore have been furnished to the trade for at least seven (7) years by a relatively few forge shops which possess the necessary skill and knowledge to produce results which are capable of passing stringent inspection and the required metallurgical testing criteria.

However, these relatively few forge shops described employed a method of obtaining the mandatory exterior configuration for nuclear nozzles which is totally different from the process of the present invention, as will appear shortly hereinafter.

Because of the foregoing factors, including the huge size and weight of the billet and the necessary intricate exterior configuration of a multiple-diameter product, it apparently never occurred to anyone possessing the average skill in the particular art that prior to my invention, that there was any way of manufacturing nuclear nozzles of the type described other than to initially obtain a round billet of appropriate weight and dimensions, and machine from appropriate locations on the billet adequate quantities of metal to arrive at the required exterior configuration.

According to the teachings of the present invention, and as disclosed in my earlier applications referred to earlier herein, the large, heavy-duty self-reinforcing ferrous-metal centrally-bored nuclear nozzles are manufactured principally by a forging operation which is followed by a minimal amount of machine-finishing which is very quick and easy because it is along a cylindrical pattern of unchanging diameter. As will appear hereinafter, the amount of machining required of the present invention is less than one-half of that which is required of the prior art practice earlier described.

Besides this very significant advantage, the forging step of the invention, which constitutes what is by far the vast majority of the entire manufacturing process, produces a kneading or mechanical working of the metal, which is heated to forging temperature, such as very markedly refines the grain structure thereof to an extent that practically any portion of the product as forged will be found to be of such metallurgical quality as will yield composite test specimens that will readily pass the required thesis for nuclear nozzles as established by the Nuclear Codes of The American Society Of Mechanical Engineers.

Such a result, as described immediately hereinbefore, is totally incapable of the product of the prior art, which is obtained practically entirely by machining, except for a preliminarily removed portion of metal in what might be termed the heart of the work-piece and which is very difficult to remove. Even then it frequently happens that since no appreciable refinement or kneading of the metal takes place during the prior-art at ambient temperatures, the composite test specimen, which has been removed by sawing with so much difficulty, will not always be found to contain acceptable individual test specimens; in which event another specimen will be sawed out and heat-treated at 1275° for 18 hours, and if these do not pass then the thermal buffer must be welded back on the nozzle forging and the entire forging heated up to 2,000°—then quenched in water and then slow cooled—after which the third and fourth test specimen saw cut slices are removed from the forging. After this there is another heat treatment at 1275° for 18 hours and if these specimens do not pass the big forging is scrapped (because there is no more metal to test) so a new nuclear nozzle has to be made with the tests starting all over again.

The advantages of the invention, as thus far described, are obtained by a combination of the use of the interior or cavity of the hereinbefore described novel female forging die with its two co-axial cylindrical sections of different diameter and intermediately disposed and interconnecting frusto-conical section, together with equally novel means for forwardly displacing the metal of the highly-heated metal of the billet into and throughout the cavity of the die.

The advantages of the present invention as described hereinbefore, and other and additional advantages and objectives will become more readily understood from the following description and annexed drawings, wherein like reference characters designate like parts, and wherein:

FIG. 1 is a transverse sectional view of a conventional nuclear nozzle of the mandatory exterior configuration described earlier herein, and possessing a cylindrical bore of appropriate diameter.

FIG. 2 is an elevation illustrating in solid lines the configuration of a forging of the prior art with the area outside of the dotted lines delineating that portion of the forging from which there is to be cut a large composite test specimen from which individual test specimens are subjected to appropriate metallurgical tests, and after which, presuming the individual test specimens are found acceptable, the remainder of the delineated mass is removed entirely by very substantial and very time-consuming and expensive machining operations of the nature earlier described.

FIG. 3 is an elevational view, partly in section, illustrating the conventional female forging die as used according to prior art practices to obtain, by a relatively light forging operation, the round and compacted body as illustrated therein and from which the composite test specimen is to be sliced or cut, and subsequently from which the remainder of the area delineated by dotted lines in FIG. 2 is machined to provide the mandatory exterior nuclear nozzle configuration, provided the individual test specimens pass the required metallurgical tests.

FIG. 4 is a schematic plan view of a diagram according to which slabs of metal are sliced from the billet to obtain composite metallurgical test specimens according to the practices of the prior art, a total of five such slabs being indicated.

Before proceeding with a description of the apparatus of the invention, it should be pointed out that according to the illustrative embodiment, the process does not commence with the usual round billet which has been lightly-forged and compacted as by the use of a prior art ring-die such as illustrated in FIG. 3; but with a work-piece which is similar, in a general way, to the one which is shown and described in my aforementioned patent application Ser. No. 836,147, filed Sept. 23, 1977, e.g. a flanged hub.

As in the instance of my immediately aforementioned patent application, the work-piece is preferably formed in a female forging die having an interior or working cavity which is complementary to the exterior of the work-piece.

Referring to FIG. 3, the female forging die of the prior art is generally indicated at 2, and it comprises a cylindrical side-wall with an open bottom which is temporarily closed by a later-removed bottom closure plate 3. The upper end of the cylindrical side-wall of the prior art female forging die 2 is connected to a relatively flat but cylindrically-curved top 4 through the medium of a fillet 4a on a fairly long radius.

As emphasized earlier herein, the ring-like female forging die 2 of the prior art serves principally to compact the metal of the heated billet and to form a cylindrically-curved short flange at the top thereof which is ultimately to be insert-welded into the opening of the vessel shell of the nuclear reactor.

Figure 6:
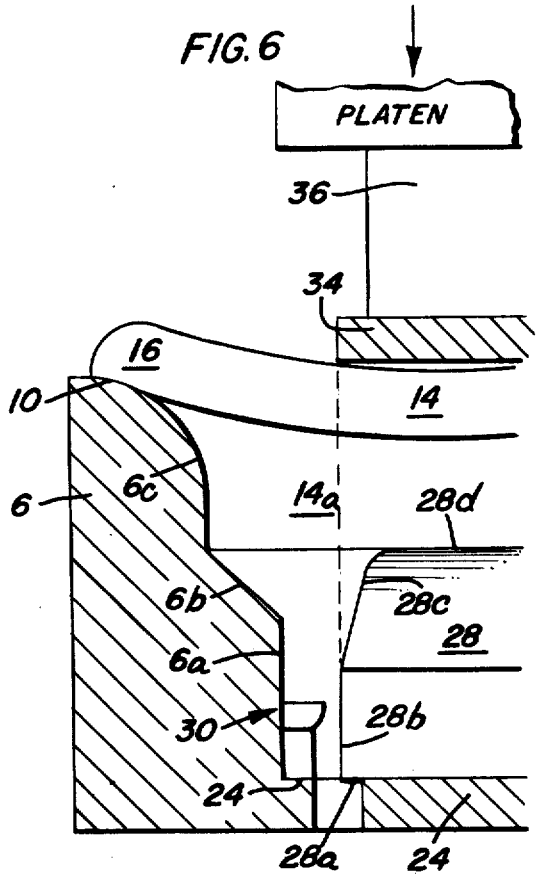
FIG. 6 is an elevational view, partly in section, of the female forging die of the invention with the highly-heated work-piece in position immediately prior to the forwardly-displacing forging step.

According to the teachings of the present invention, there is provided a large and very heavy-duty female forging die 6, as shown in FIG. 6.

It will be understood that in both FIG. 3, wherein the female forging die 2 of the prior art is represented, and in FIG. 6 wherein the female forging die 6 of the present invention is shown, the product being forged is in inverted position, with that portion of the forging which is to form the larger cylindrical base member which is to carry the outwardly-extending flange at the top of the die.

Adjacent the lower portion of the female forging die 6 of the invention, the wall 6a of the cavity is truly cylindrical and of substantial length, as will be discussed hereinafter. It is here that there is formed the smaller outer end of the nuclear nozzle plus an additional cylindrical portion which will likewise be later discussed.

The upper end of the aforementioned cylindrical section 6a of the female forging die 6 terminates at the lower end of a coaxial inverted frusto-conical section 6b which is shown as extending at an angle of approximately 45°. The upper end of this inverted frusto-conical section 6b of the cavity of the female forging die 6 connects with the lower end of a second cylindrical section 6c which is co-axial with the cylindrical section 6a but of considerably greater diameter.

This cylindrical section 6c of larger diameter forms the base member of reinforcement of the nuclear nozzle, and immediately above it there is formed the flange to be insert-welded into the opening of the nuclear vessel.

The lower end of the wall of the cavity of the female forging die 6 terminates in a relatively narrow horizontal step which extends radially inwards, as shown at 8.

The upper end of the female forging die member 6 is provided with a substantially wider outwardly-extending horizontal step 10 which is completely open at the top for the purpose of receiving the outwardly-extending or generally radial flange 16 which forms an integral part of the work-piece 14 which is heated to forging temperature before being placed in the top of the female forging die member.

Figure 5:
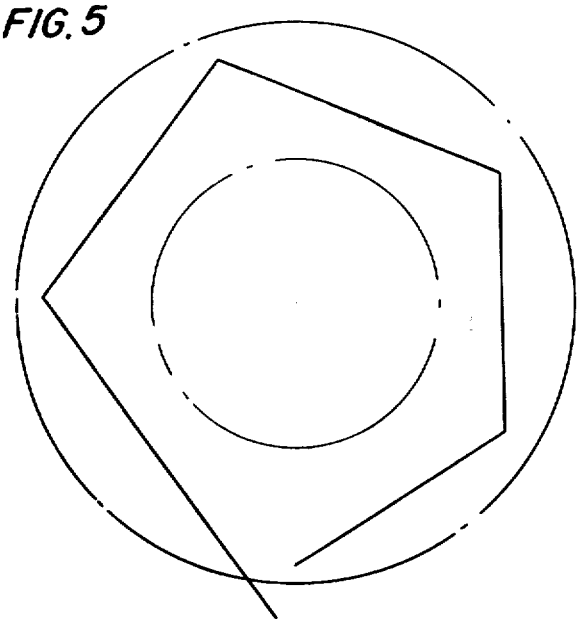
FIG. 5 is a perspective of a lightly-forged billet of the prior art after a composite test specimen has been sliced or cut immediately prior to the making of the individual metallurgical tests to determine whether that particular lightly-forged billet may be machined to provide the mandatory exterior configuration of a nuclear nozzle.

Referring to the lowermost portion of FIG. 5 of the drawings, there is disposed upon the bed of a forging press which may be of entirely conventional design, a round blocking plate 24 of a diameter which is less than the diameter of the bottom opening of the cavity of the female forging die member 6, and upon it there is disposed a vertically extending round supporting member 28 which is of larger diameter than the round blocking plate and overhangs the same, as indicated at 28a.

It is an important feature of the invention that the periphery of the round supporting member 28, which may be of the same or greater diameter than the diameter of the round blocking plate 24, is spaced from the periphery of the relatively narrow horizontally extending step 8 at the bottom of the interior of the cavity of the female forging die member 6.

As shown in FIG. 6, the lower portion of the vertically-extending round supporting member 28 is substantially cylindrical for approximately one-half its height, indicated at 28*b*, while the upper half of frusto-conical, as shown at 28*c*, terminating in a relatively flat upper extremity 28*d*.

Figure 7:
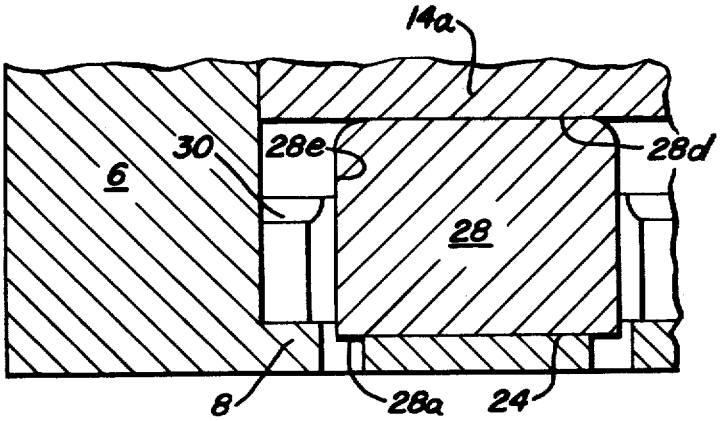
FIG. 7 is a fragmentary elevational view illustrating a modification of the apparatus as shown in FIG. 6.

In FIG. 7, the substantially cylindrical portion of the vertically-extending round supporting member 28 is shown at 28*e* as extending almost to the top thereof, terminating directly in the relatively flat upper extremity 28*d*.

It is important that in any event the relatively flat upper extremity 28*d* of the vertically-extending round supporting member 28 make contact with the flat underside of the work-piece 14 at the time of commencement of the forging action.

The relatively narrow horizontally extending step 8 supports a circular forging knife 30 which is disposed immediately opposite the cylindrical portion 28*b* (FIG. 6) or 28*e l* (FIG. 7) of the vertically-extending round supporting member 28.

The inner diameter of the circular forging knife 30 on the horizontal step 8 is, of course, only slightly larger than the diameter of the space which is circumscribed by the horizontal step 8, thereby permitting the exterior of the displacement disc 34 to pass therethrough during the completion of the forging operation.

The height of the hub portion 14*a* of the work-piece 14 and that of the upper generally radial flange 16 is predetermined, depending upon the desired length of the frusto-conical section and that of the cylindrical section of smaller diameter of the end product. The uppermost surface of the generally radial work-piece 14 is cylindrically-curved inwardly at its area of connection with the hub 14*a*.

As shown at the upper end of FIG. 6, a metal-displacement disc 34 is centered upon the top of the solid round work-piece 14, the diameter of said metal displacement disc being the same as the diameter of the cylindrical portion 28*b*, but slightly less than the inside diameter of the circular forging knife 30.

The lower end of a round forging press follower 36 is centered upon the metal-displacement disc 34, the same being of a diameter which is slightly less than that of the metal displacement disc.

The upper and movable element or platen of the forging press is lowered onto the top of the round forging press follower 36, and the metal-displacement disc 34 is pushed downwardly to force the heated metal beneath it to flow into the cylindrical cavity of the die-forming instrumentalities which terminate at the upper surface of the circular forging knife 30. At this point the female forging die member 6 is raised and the blocking plate 24 removed.

Then the downward movement of the metal-displacement disc 34 is continued while the female forging die member 6 is raised until all of the forwardly displaced metal becomes part of the forged end product.

The work-piece 14 may be provided from storage, heated to forging temperature, and then disposed in the female forging die member 6 as shown in FIG. 6.

As an alternative, there may be used a hot rounded billet (with a straight periphery) and of a diameter which is slightly less than the diameter of the cavity of the female forging die member 6 which is blocked-up solid in the center up to the height of the hub portion which is desired in the forged end product. Then that portion of the rounded billet (with straight periphery) which extends above the female forging die member 6 is mashed-down with a flat disc (not shown) which is of sufficient diameter to cover at least the outwardly-extending and generally horizontal step 10 at the top of the female forging die member 6, utilizing the upper and movable platen of the forging press. Thus, the metal of the billet is upset to cover the horizontal step 10, and thereby provide the outwardly and slightly upwardly extending flange which is to be insert-welded into the opening of the metallic vessel of the nuclear reactor.

At this point, the resultant work-piece 14 is removed from the female forging die member 6 and reheated.

The blocking referred to hereinbefore is removed, and then the secondary instrumentalities are added; e.g. the circular forging knife 30, the vertically-extending round supporting member 28, and blocking in the form of the round blocking plate 24.

Figure 8:
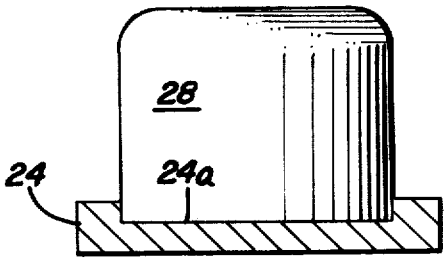
FIG. 8 is a sectional elevation illustrating another modification.

As shown in FIG. 8, the round blocking plate 24 may be provided with a centrally disposed circular recess 24*a* of say, ¼-inch depth for receiving the round bottom of the vertically-extending supporting member 28, thus serving as a centering device. Other types of centering device may, of course, be substituted, the same comprising, as such, no part of the present invention.

Only a small amount of scrap results; and the entire method is characterized by great savings in weight of the metal which has to be utilized.

Much improved metallurgical qualities result from the extensive kneading or working of the highly-heated metal during the forward displacement thereof.

In addition, the apparatus employed is essentially economical, and quick and easy to operate by a minimum of workers.

RECAPITULATION

THE PRIOR ART METHOD

The billet of the prior art method of manufacturing ferrous-metal self-reinforcing nuclear nozzles initially heated to hot-working temperatures of 2,000°–2,200° F., just as in the case of the billet of the invention.

However, the billet of the prior art is while heated to forging temperature rounded-up and compacted in a ring die and while therein upset on one end to form the insert flange, as shown at 2 in FIG. 3, during which a very minor amount of kneading or working of the metal takes place; and that only on the insert flange. The compacting or rounding-up of the billet and formation of the insert flange is followed by the removal of a large and heavy slab of metal in the manner earlier described to obtain the necessary composite test specimen. In the event any of the individual test specimens of the billet of the prior art method are found to meet the requirements for nuclear nozzles, either in the first-removed large slab or slice of metal according to the prior art method, or one of the succeedingly removed large slabs or slices; then the billet or work-piece is subjected to an extensive machining operation to provide the required configuration for nuclear nozzles. During this expensive and time-consuming machining operation of the prior art there is no substantial change in the fiber pattern or grain growth of the metal of the work-piece, as illustrated in FIG. 9.

THE INVENTION

Figure 9:
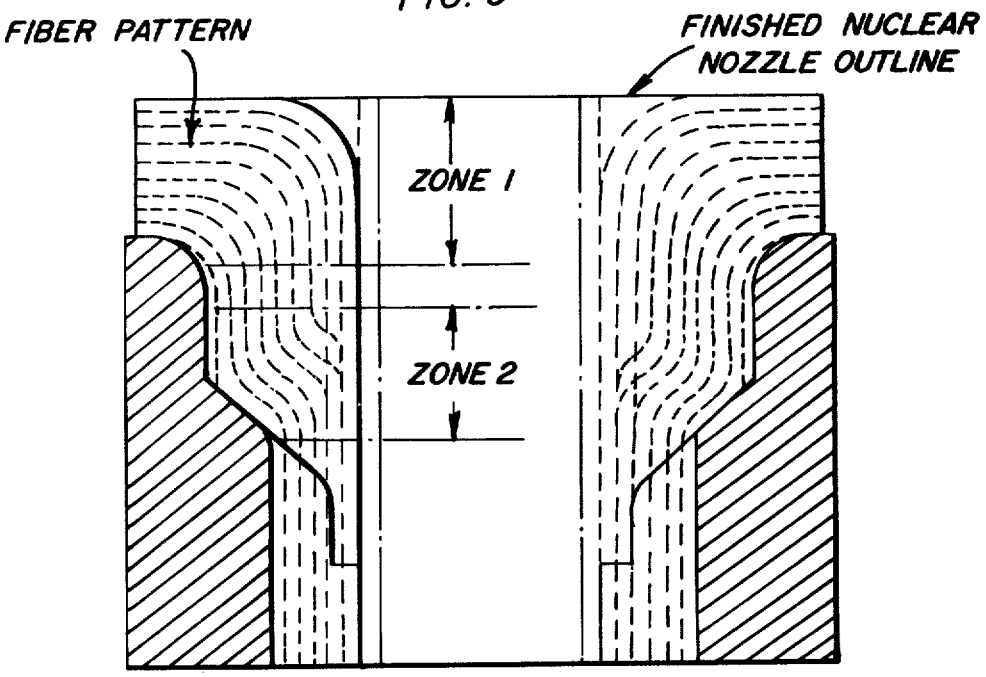
FIG. 9 is a sectional elevational view of the fiber-pattern or grain-orientation of the metal of the finished nuclear nozzle outline as obtained by the practice of the present invention which necessarily involves forward displacement of the metal of the rounded billet when heated to forging temperature into the novel multiple diameter female forging die with frusto-conical midsection.

The ferrous-metal low alloy billet of the invention is initially heated to hot-working temperature, i.e. between 2,000° F. following which the required exterior configuration for ferrous-metal nuclear nozzles is obtained by a single massive forging step, during which a very substantial amount of kneading or hot-working of the metal takes place and the proper fiber-pattern i.e. work-oriented or directional grain growth is imparted to the heavy forging in both the insert flange end and the opposite or outlet end, as represented in FIG. 9.

The extra cylindrical portion which is provided on the extremity of the cylindrical section of smallest diameter of the work-piece of the invention is then easily and speedily removed, as by sawing, and the test specimens so removed will be found to be fully acceptable in every instance because of the great degree to which the billet being forged was kneaded or "worked" in the cavity of the female forging die. This is guaranteed by the massive hot-forging of the work-piece (billet) according to the process of the invention. It is never necessary to remove additional composite test specimens to replace individual test specimens which failed.

After the aforementioned heavy or massive hot-working step the process of invention requires only a light machining-finishing step which is quick and easy because it is conducted on a surface which is entirely round. See FIG. 6.

It has long been known that due to increased trends towards larger vessels at higher pressures and temperatures increased strength and increased safety factors, metal pressure vessels and their components must provide the highest performance levels. Like practically everything else related to pressure vessels, the best performance in nozzles naturally depends upon a combination of inherent material properties and how the metal is forged; and this is particularly true with respect to the art of nuclear nozzles.

Due to the very important fact that the billet or work-piece of the process of the invention is so much smaller in diameter, as indicated in the attached drawings and throughout the specification, there is much cleaner steel at the center of the billet than in the case of the practices of the prior art.

It is clear that according to the invention the diameter of the billet or work-piece must be smaller than the diameter of the narrowest portion of the female forging die 6.

Another important aspect of this feature of the invention is that it could conceivably happen that reheating of the forging to relieve strains is necessary; and that such reheating might require the attachment to the small end of the work-piece of a thermal buffer in the form of a radially-flanged continuous metal ring of substantial thickness and to the I.D. and O.D. at the forging to which it is attached by continuous electric welding.

The attachment of a thermal buffer is by means of a continuous welded joint which is not only troublesome, but it is time-consuming which involves considerable expense. It is also time-consuming and expensive to remove a thermal buffer after it has served its intended purpose.

Due to the very much smaller diameter of the end of applicant's work-piece the trouble, time and expense of both attaching and removing a thermal buffer, wherever one is required, is tremendously reduced.

It is of even greater importance that the fiber pattern or grain flow of the metal of the work-piece be parallel to the stress system of the nozzle; that is the fibering or directional characteristics of the forged steel should follow and be parallel to the stresses to which it is to be subjected in service. This desired fiber pattern should, besides being oriented to the contour of the finished nozzle and its corresponding transition radius, be continuous and unbroken.

Referring to FIG. 9, the strong fiber pattern obtained by the practice of applicant's process is illustrated as comprising the dashed-lines that are straight up-and-down except for two widely-spaced areas which are indicated as ZONE 1 and ZONE 2.

ZONE 1 is the area wherein the generally radially extending insert-flange was obtained by the swaging of the upper end of the billet while it is in the novel female forging die 6 of the invention and the grains of the pattern are curved in the manner shown.

In FIG. 9, ZONE 2 is shown as comprising that portion of the metal of the billet or work-piece which is within the frusto-conical section of the female forging die 6. It will be observed that the fiber pattern or grain flow of the metal which is within ZONE 2 is represented by reversely-curved lines which flow into that portion of the metal of the billet or work-piece which is to form the outlet end of the nuclear nozzle. This fiber pattern as represented in ZONE 2 is of the greatest importance since there are no breaks or mechanical notches in the grain flow into and through the outlet end of the nozzle.

There is no other known way of obtaining the fiber pattern within ZONE 2 as illustrated except by the use of the novel female forging die of the invention.

Immediately following is a CHART wherein the weights of the metal of six sizes of nuclear nozzles as set forth in Column I are compared as between the practices of the prior art, the process of the present application, and the process of my pending patent application which was executed on Jan. 7, 1978.

CHART

| I Dimensions | II Weight Required When Product Formed By Back Extrusion (as in the case of my pending Patent Application executed on Jan. 7, 1978) OR By Forward Displacement as in the case of the Present Application | III Weight Displaced By Back Extrusion or Forward Displacement | IV Weight Required When Using the Prior Art Method Which Utilizes Extensive Machining Operations |
|---|---|---|---|
| 18" | 5690 | 1353 | 6466 |
| 20" | 6861 | 1820 | 8078 |
| 22.062" | 9036 | 2528 | 11362 |
| 23.647" | 9012 | 2832 | 11177 |
| 25.25" | 10023 | 3428 | 15170 |

CHART-continued

| I Dimensions | II Weight Required When Product Formed By Back Extrusion (as in the case of my pending Patent Application executed on Jan. 7, 1978) OR By Forward Displacement as in the case of the Present Application | III Weight Displaced By Back Extrusion or Forward Displacement | IV Weight Required When Using the Prior Art Method Which Utilizes Extensive Machining Operations |
|---|---|---|---|
| 26.207" | 12362 | 4563 | 17812 |

From the immediate foregoing the extreme savings in weight of metal used as between the process of the present invention and the practice of the prior art is manifest.

Having thus described the invention what I claim as new and desire to secure by Letters Patent is set forth immediately hereinafter:

1. The process of manufacturing on the bed of a forging press ferrous-metal multiple-diameter nuclear nozzles weighing over 4,000 pounds and with a minimum diameter of 22 inches, and wherein the exterior configuration of the nuclear nozzle comprises a cylindrical base section of largest diameter having an outwardly-extending flange at the extremity thereof, a frusto-conical section connected to the other extremity of the cylindrical base section of largest diameter, a second cylindrical section of smaller diameter connected to the other end of the frusto-conical section and a central bore; in an open-ended female forging die member having an interior configuration which generally corresponds to the aforementioned exterior configuration of the nuclear nozzle and is provided at its upper end with an upwardly and outwardly curved portion and adjacent its lower end with a relatively narrow inwardly extending horizontal step which supports a circular forging knife; said process including (a) disposing upon the bed of the forging press the hereinbefore described open-ended female forging die member together with an interiorly and centrally positioned round blocking plate of lesser diameter;

(b) centrally positioning upon the round blocking plate a round and vertically extending supporting member of lesser diameter than the bottom of the female forging die member but slightly lesser diameter than the inner diameter of the circular forging knife and having a generally cylindrical sidewall merging upwardly into a rounded edge portion with a flat centrally disposed uppermost extremity and extending above and through the opening of the circular forging knife;

(c) placing in the upper end of the female forging die member a solid round heated work-piece having a lower peripheral portion which is of slightly less diameter than the largest diameter of the cavity of the female forging die member and an upper flange portion which substantially fully occupies upwardly and outwardly curved portion at the upper extremity of the female forging die member;

(d) centering on the top of the aforementioned heated work-piece a metal-displacement disc which is of substantially the same diameter as that of the lower cylindrical wall of the round supporting member on the round blocking plate in the bottom of the female forging die member;

(e) moving the metal-displacement disc downwardly with the aid of the upper movable element of the forging press and an intermediately disposed round forging press follower of a diameter which is somewhat less than the diameter of the metal displacement disc until the metal of the heated work-piece directly below said displacement disc is extruded to entirely fill the cavities therebelow which terminate at the upper surface of the circular forging knife, the adjacent portions of the aforementioned supporting member and the interior of the female forging die;

(f) raising the female forging die member; and (g) with the aid of the upper movable element of the forging press and the round forging press follower pushing the metal and the supporting member; below the metal-displacement disc through the circular forging knife to form the central bore of the end product.

2. The process of claim 1 wherein the upper end of the cylindrical wall of the vertically extending round supporting member merges into the upper rounded edges and flat upper extremity through an intermediately disposed frusto-conical section.

* * * * *